US006005227A

United States Patent [19]

Pappas

[11] Patent Number: 6,005,227

[45] Date of Patent: Dec. 21, 1999

[54] TOWEL WARMER CONSOLE CABINET

[76] Inventor: Steve Pappas, 40 Hearth Stone Dr., Chesire, Conn. 06410

[21] Appl. No.: 09/217,690

[22] Filed: Dec. 21, 1998

Related U.S. Application Data

[63] Continuation of application No. 08/919,642, Aug. 28, 1997.

[51] Int. Cl.[6] ..... F26B 9/06; F27D 7/04

[52] U.S. Cl. ..... 219/400; 219/386

[58] Field of Search ..... 219/385, 386, 219/400; 34/104, 106, 202, 212, 215, 218, 219, 225, 233, 239, 240; 126/21 A

[56] References Cited

U.S. PATENT DOCUMENTS

| | | | |
|---|---|---|---|
| 1,767,157 | 9/1930 | Steele | 34/233 |
| 2,111,148 | 3/1938 | Judelson | 219/400 |
| 2,179,256 | 11/1939 | Gill | 219/400 |
| 3,286,370 | 11/1966 | Hope | 34/225 |
| 3,288,129 | 11/1966 | Fox | 126/21 A |
| 3,432,939 | 3/1969 | Eichholz | 34/218 |
| 3,820,251 | 6/1974 | Abernathy | 34/202 |
| 3,839,622 | 10/1974 | Mastin | 219/400 |
| 4,117,309 | 9/1978 | Cayley . | |
| 4,644,136 | 2/1987 | Watchman | 219/400 |
| 4,684,787 | 8/1987 | Bunting | 219/400 |
| 4,856,206 | 8/1989 | Klein | 34/619 |
| 4,918,290 | 4/1990 | DeMars | 219/400 |
| 5,379,525 | 1/1995 | Raynor | 34/239 |
| 5,555,640 | 9/1996 | Ou | 34/202 |
| 5,569,403 | 10/1996 | Swanson et al. | 219/400 |
| 5,592,750 | 1/1997 | Eichten | 34/104 |
| 5,666,743 | 9/1997 | Dawson | 34/219 |
| 5,842,287 | 12/1998 | Murphy | 34/202 |

*Primary Examiner*—Joseph Pelham

[57] ABSTRACT

A warming unit in the form of a console cabinet having a transparent cover includes a circulating fan mounted on the bottom of the cabinet and an electric heater is mounted on a side wall thereof. Four posts extending from the bottom are arranged around the circulating fan to support towels and the like for drying and heating. The heated air is directed in a continuos circular path from the heater through the towels for optimum thermal transfer.

11 Claims, 2 Drawing Sheets

TOWEL WARMER CONSOLE CABINET

This application is a continuation of Ser. No. 08/919,642 filed Aug. 28, 1997.

DESCRIPTION OF THE PREFERRED EMBODIMENT

Figure 1:
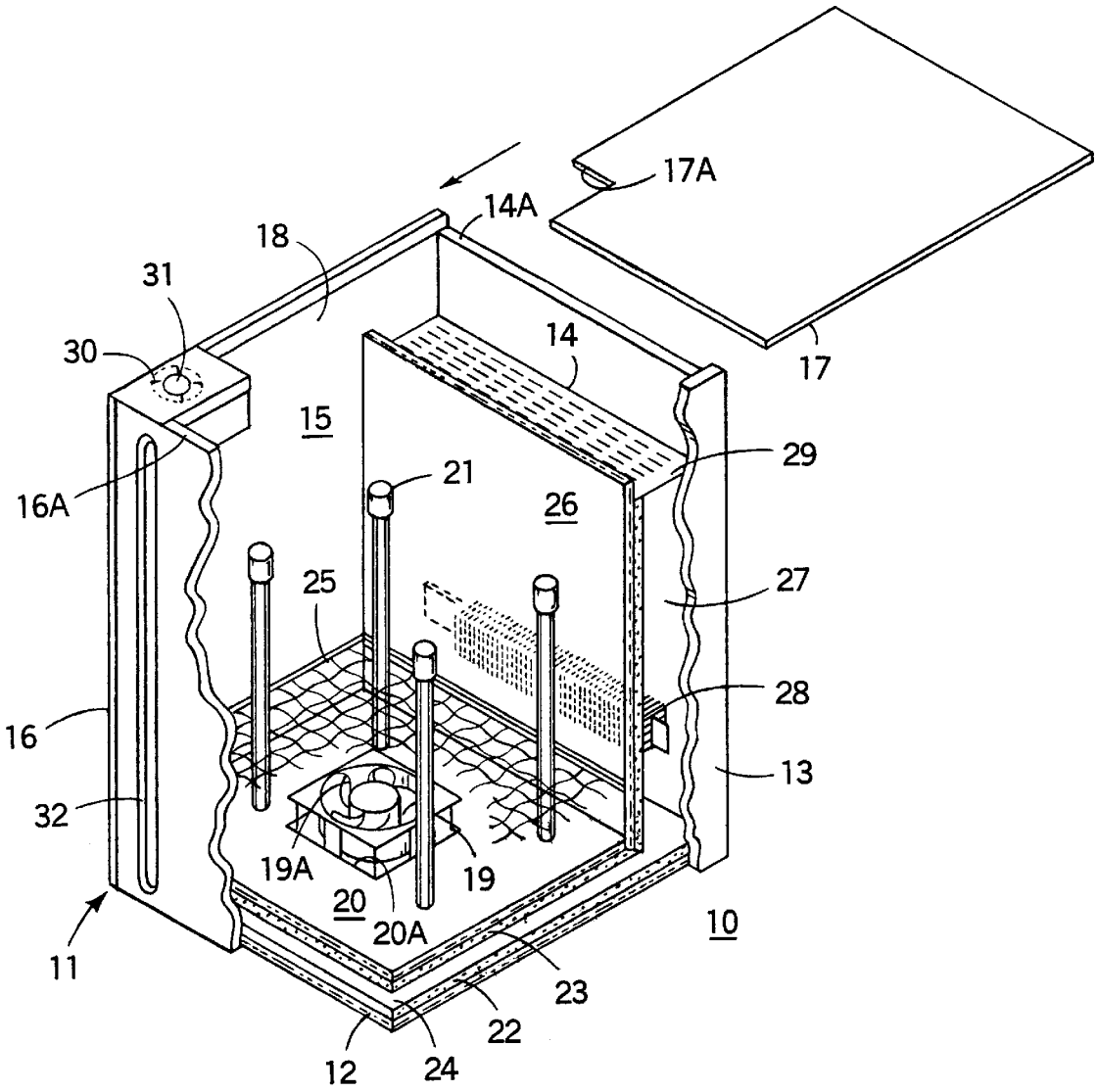
FIG. 1 is top perspective cut away view of the heating cabinet according to the invention.

The towel warmer unit 10 is shown in FIG. 1 and includes a console 11 consisting of a base 12, and four side walls 13–16 formed of a paneled wood or melamine material that is used with custom furniture. A transparent cover 17 of glass or plastic material is slidingly arranged over the top opening 18 defined between the side walls and is positioned on the top 14A and top 16A of the opposing side walls 14, 16, the cutout 17A provides clearance for the electric thermostat 30 that is mounted at the top of the console between side walls 15, 16 as indicated. A circulating fan 19 is positioned on the floor 20 with four upright posts 21 arranged around the fan to receive the towels or clothes (not shown) in draped fashion over the tops thereof. A screen 25 is arranged over the fan to prevent any of the towels or clothes from contact with the fan blades 19A. To thermally isolate the console from the support floor (not shown), a layer 22 of insulation is provided on the base 12 and to assist in retaining the heat within the console, a layer of insulation 23 is arranged on the bottom of the floor 20. A bottom air passage or bottom airway 24 is defined between the insulation layers 22, 23 and is exposed to the bottom of the fan 20 by means of the aperture 20A. The bottom airway 24 connects with a side air passage or side airway 27 that is defined between the console side wall 14 and the inner wall 26. The electric heater 28 is positioned within the side air way near the bottom for optimum heat transfer between the fan and the electric heater. The top of the side air way 27 is closed by a vent 29 to prevent inadvertent contact with the electric heater. Electrical connection between the thermostat 30, fan 20 and the electric heater 28 is made by means of the electric cable 32 that passes through a part of the bottom airway way 24 and the side air way 27 by separate conductors that are not shown for purposes of clarity. The control knob 31 on the electric thermostat 31 allows a user to accurately set the amount of electricity supplied to the electric heater to adjust accordingly for the number of objects that may be positioned on the poles 21 as well as their size and composition.

Figure 2:
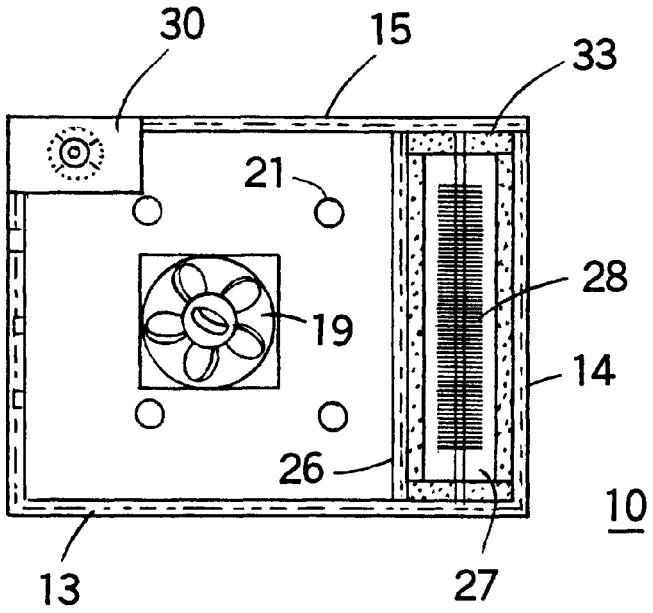
FIG. 2 is a top plan view of the heating cabinet of FIG. 1 with the cover removed to detail the interior components.

The relative positioning between the interior components such as the fan 19, posts 21 and electric heater 28 of the towel warmer unit 10 is best seen by now referring to FIG. 2. To optimize the thermal efficiency of the electric heater, insulation layers shown generally at 33 that are provided on the interior of the opposing sidewalls walls 13, 15 and on the interior of the inner wall 26 and side wall 14.

Figure 3:
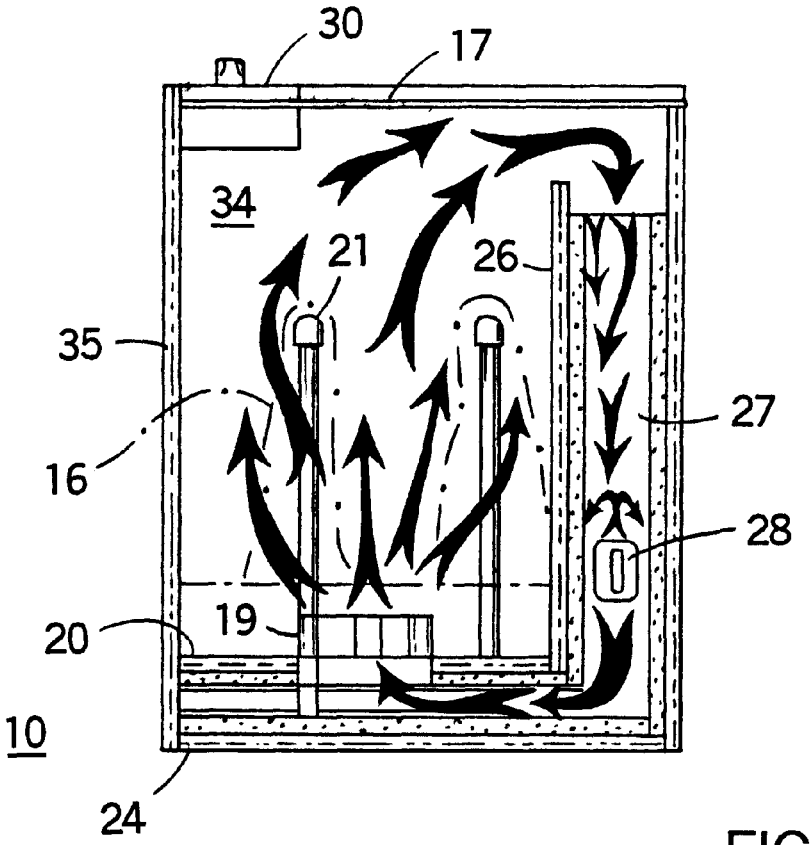
FIG. 3 is a cut away side view of the heating cabinet of FIG. 1 depicting the flow path of the heated air.

The air transport path is indicated by arrows in the side view of the towel warmer unit 10 shown in FIG. 3. The closed space 34 defined between the cover 17 and the floor 20 becomes rapidly heated by direction of the air by the fan 19 upwards within the space against the towels 35 shown in phantom and down through the side air way 27, past the electric heater 28 back along the bottom air way 24 to the fan 19 continuously. The operating speed of the fan 19 is previously adjusted such that standard sized bath towels flutter with the passage of the heated air to improve the rate at which the towels become heated. In some embodiments of the invention, the electric thermostat can include a timer unit to turn the fan and electric heater off after predetermined time periods to avoid overheating.

A highly efficient towel and other cloth article heating device has herein been described whereby the location of the circulating fan, object to be heated and electric heater are optimally positioned to promote the fastest heating cycles never heretofore attainable.

What is claimed is:

1. A heating unit for fabrics a console having four upright sidewalls joined by a bottom and open at the top;

a cover movably arranged on said console for closing said top;

a circulating fan on said bottom;

a bottom airway defined beneath said bottom for allowing air transfer through said fan;

a side airway defined between an interior wall and one of said upright sidewalls, said interior wall extending from said bottom in a plane parallel to said one sidewall for allowing air transfer along said side airway;

an electric heater arranged within said side airway for providing heat to said console; and a plurality of posts extending from said bottom in a plane parallel to said sidewalls and arranged around said circulating fan within said console for supporting fabrics to be heated, said support means comprising a plurality of posts extending from said floor and arranged around said circulating fan.

2. The heating unit of claim 1 including a timer unit connecting with said electric heater to control the amount of heat generated within said console.

3. The heating unit of claim 1 including a base under said bottom and a layer of thermal insulation on an inner surface of said base.

4. The heating unit of claim 3 including a layer of thermal insulation on an outer surface of said floor.

5. The heating unit of claim 1 including a layer of thermal insulation on an inner surface of said one sidewall.

6. The heating unit of claim 1 including a layer of thermal insulation along an outer surface of said interior wall.

7. The heating unit of claim 1 including a screen arranged over said fan for preventing said object from coming into contact with said circulating fan.

8. The heating unit of claim 1 including a vent arranged over a top of said side airway for preventing inadvertent contact with said electric heater.

9. The heating unit of claim 1 wherein said cover comprises glass or plastic.

10. The heating unit of claim 1 wherein said sidewalls comprise wood or melamine.

11. The heating unit of claim 1 wherein said electric heater is positioned at a bottom part of said side airway.

* * * * *